US012522941B2

(12) United States Patent
Gleissner et al.

(10) Patent No.: US 12,522,941 B2
(45) Date of Patent: Jan. 13, 2026

(54) PLATING FRAME UNIT FOR HOLDING A SUBSTRATE IN A CHEMICAL AND/OR ELECTROLYTIC SURFACE TREATMENT OF THE SUBSTRATE

(71) Applicant: SEMSYSCO GMBH, Salzburg (AT)

(72) Inventors: Andreas Gleissner, Dobriach (AT); Ulrich Tschinderle, Villach (AT)

(73) Assignee: SEMSYSCO GMBH, Salzburg (AT)

( * ) Notice: Subject to any disclaimer, the term of this patent is extended or adjusted under 35 U.S.C. 154(b) by 479 days.

(21) Appl. No.: 18/015,941

(22) PCT Filed: May 3, 2021

(86) PCT No.: PCT/EP2021/061540

§ 371 (c)(1),
(2) Date: Jan. 12, 2023

(87) PCT Pub. No.: WO2022/042892

PCT Pub. Date: Mar. 3, 2022

(65) Prior Publication Data

US 2023/0265577 A1 Aug. 24, 2023

(30) Foreign Application Priority Data

Aug. 25, 2020 (EP) ..... 20192707

(51) Int. Cl.
*C25D 17/06* (2006.01)
*C25D 17/00* (2006.01)

(52) U.S. Cl.
CPC ..... *C25D 17/06* (2013.01); *C25D 17/005* (2013.01)

(58) Field of Classification Search
CPC ..... C25D 17/06
See application file for complete search history.

(56) References Cited

U.S. PATENT DOCUMENTS 5,660,699 A * 8/1997 Saito ..... C25D 17/06 204/297.08
2002/0127956 A1* 9/2002 Ashjaee ..... H01L 21/6838 451/54

(Continued)

FOREIGN PATENT DOCUMENTS

JP H04246200 A 9/1992
JP H08225982 A 9/1996

(Continued)

OTHER PUBLICATIONS

Taiwan Office Action with Translation for Application No. 110117730, dated Jun. 6, 2023.

(Continued)

*Primary Examiner* — Luan V Van
(74) *Attorney, Agent, or Firm* — MARSHALL, GERSTEIN & BORUN LLP

(57) ABSTRACT

The disclosure relates to a plating frame unit for holding a substrate in a chemical and/or electrolytic surface treatment of the substrate and a method for assembling a plating frame unit for holding a substrate in a chemical and/or electrolytic surface treatment of the substrate. The plating frame unit comprises a front plate, a back plate, and a vacuum unit. The front plate comprises a front frame portion surrounding a front recess portion. The back plate comprises a back frame portion. The front frame portion and the back frame portion are connected to each other to hold the substrate between them. The vacuum unit is configured to reduce an inner pressure between the front frame portion and the back frame portion below a surrounding pressure to attach the front frame portion relative to the back frame portion.

14 Claims, 4 Drawing Sheets

(56) References Cited

U.S. PATENT DOCUMENTS

| | | | | |
|---|---|---|---|---|
| 2004/0037682 | A1 | 2/2004 | Yoshioka et al. | |
| 2009/0090631 | A1 | 4/2009 | Dubin et al. | |
| 2010/0320090 | A1 | 12/2010 | Yoshioka et al. | |
| 2016/0194776 | A1* | 7/2016 | Weinhold | C25D 17/06 205/137 |
| 2018/0138408 | A1* | 5/2018 | Lassiter | C23C 14/56 |
| 2018/0182659 | A1* | 6/2018 | Yokoyama | C25D 17/06 |
| 2022/0098751 | A1 | 3/2022 | Murakoshi et al. | |

FOREIGN PATENT DOCUMENTS

| | | | | |
|---|---|---|---|---|
| JP | 2000199099 | A | * | 7/2000 |
| JP | 2004-076072 | A | | 3/2004 |
| JP | 2007131931 | A | | 5/2007 |
| JP | 6481910 | B2 | | 3/2019 |
| JP | 2020117764 | A | | 8/2020 |
| WO | WO-2016/190180 | A1 | | 12/2016 |

OTHER PUBLICATIONS

International Search Report and Written Opinion of the International Searching Authority for Application No. PCT/EP2021/061540, dated Jul. 19, 2021.
Japanese Office Action for Application No. 2023-505745.

* cited by examiner

PLATING FRAME UNIT FOR HOLDING A SUBSTRATE IN A CHEMICAL AND/OR ELECTROLYTIC SURFACE TREATMENT OF THE SUBSTRATE

CROSS-REFERENCE TO RELATED APPLICATIONS

This present application is the US national phase of International Patent Application No. PCT/EP2021/061540, filed May 3, 2021, which claims priority to European Application No. 20192707.6, filed Aug. 25, 2020. These applications are hereby incorporated by reference in their entireties.

TECHNICAL FIELD

The disclosure relates to a plating frame unit for holding a substrate in a chemical and/or electrolytic surface treatment of the substrate and a method for assembling a plating frame unit for holding a substrate in a chemical and/or electrolytic surface treatment of the substrate.

BACKGROUND

Electroplating is one of the most used technologies in many different industries, especially in the semiconductor related industries, to metallize surfaces or parts of surfaces. The reasons are the simplicity and scalability of the electroplating process to various types of substrates and various sizes of substrates. Additional advantages such as low cost of operation make electroplating or electrodeposition a preferred method for a metallization of a substrate. In addition, multiple substrates can be processed at the same time.

In order to achieve an adequate film quality and uniformity during the electroplating process, it is especially important to guarantee very good electrical contacts to the one or multiple surface(s) of the substrate, where usually one or multiple conductive seed-layer(s) is/are already present to distribute a current density over the surface area(s) of the substrate. Very good electrical contacts are achieved by mounting the substrate for the electroplating process to a plating frame, which works as a supporting frame during the electroplating process. The plating frame is at the same time functioning as a handling frame to transfer the substrate from a loading/unloading station through the electrolyte plating system and process sequence and back to the loading/unloading station. The plating frame can also be designed to handle multiple substrates simultaneously.

Prior art plating frames are consisting of two frame parts, an upper and a lower half-frame, in-between which a substrate is sandwiched through mechanical force. The frame parts are pressing electrical contacts to the substrate surface, which has been prepared with a seed-layer for the electroplating process. Some frames are clamped together; some must be manually screwed together. A sealing ring around the electrical contacts may be used to avoid that the electrical contacts are electroplated, which is then called a dry-contact frame. There are also so-called wet-contact frames, which do not seal the electrical contacts from the electrolyte solution.

Prior art plating frames are applying a mechanical force to ensure a secure fixation of the substrate through complex geometry clamping systems, which typically require a significant amount of screws to be fastened manually. Such manual fastening processes very often lead to non-homogeneous forces being exerted onto the substrate and this very often results in unreliable electrical contacts yielding a non-uniform electroplating process.

Due to the required intervention for securing the substrate through manual fastening of screws also a fully automated loading and unloading of the substrates is not possible or only possible through an implementation of complex robotic systems.

Another major disadvantage of these complex geometry clamping systems is the existence of corners, edges and gaps, which are very challenging and time consuming to rinse and dry after the electroplating process. A thorough rinse for removing all chemical residues as well as a thorough dry for not leaving any drying residues is essential for a successful completion of the electroplating process.

In case of dry-contact frames, large parts of the substrate surface are shielded from the electrolyte plating solution. In this way, a significant area on the top surface of the substrate is consumed for making the electrical contacts, which reduces the available surface area for building devices. It would be of significant cost advantage for the electroplating process if more of the surface area can be used for functionality.

In addition, it has been found that dry-contact frames, using a sealing ring to protect the electrical contacts, are very problematic for automatic loading and unloading of large-scale substrates and often result in a failing electrical contact. Such failing electrical contact is mostly not immediately detected, but only detected after the electroplating process, when the substrate is already miss-processed and has to be scrapped at a high cost.

In case of wet-contact frames, the electrical contacts or pins usually provide very reliable electrical contacts, but become heavily coated during the electroplating process. The heavily coated electrical contacts result over time in a larger surface contact area, which leads to a plating variability for subsequently processed substrates (larger amounts of current will pass through, when the contact area increases).

At the same time, the electrical contact areas when using wet-contact frames tend to plate with a thicker layer of metal (over-plating) on the substrate surface compared to other areas on the substrate. When the substrate is now processed through the electroplating process several times during the build of the devices (often up to 10 times and more), significantly thicker metal layers in the electrical contact areas can create problems during subsequent processing of the substrate, e.g. during coating with subsequent surface-layers, like photoresist layers or insulation- or passivation layers.

SUMMARY

Hence, there may be a need to provide an improved plating frame unit for holding a substrate in a chemical and/or electrolytic surface treatment of the substrate, which allows in particular a more uniform electroplating process.

Above described problem is solved by the subject-matters of the independent claims, wherein further embodiments are incorporated in the dependent claims. It should be noted that the aspects of the invention described in the following apply also to the plating frame unit for holding a substrate in a chemical and/or electrolytic surface treatment of the substrate and the method for assembling a plating frame unit for holding a substrate in a chemical and/or electrolytic surface treatment of the substrate.

According to the present disclosure, a plating frame unit for holding a substrate in a chemical and/or electrolytic surface treatment of the substrate is presented. The plating frame unit comprises a front plate, a back plate, and a vacuum unit.

The front plate comprises a front frame portion surrounding a front recess portion.

The back plate comprises a back frame portion. Optionally, the back frame portion surrounds a back recess portion.

The front frame portion and the back frame portion are connected to each other to hold the substrate between them.

The vacuum unit is configured to reduce an inner pressure between the front frame portion and the back frame portion below a surrounding pressure to attach the front frame portion relative to the back frame portion.

The front plate and the back plate can together form a plating frame. The front plate and the back plate can each form a frame surrounding a recess or hole.

The front frame portion and the back frame portion are connected to each other, which can be understood in that they are only in contact, lay next to each other and touch each other. They are not fastened to each other.

The inner pressure can be understood as the pressure within an interior of a cavity formed and surrounded by the front frame portion and the back frame portion.

The surrounding pressure can be understood as atmosphere pressure.

The vacuum unit can be understood as a pump and in particular as a suction pump. The pressure difference between the inner pressure and the surrounding pressure may lead to a suction force between the front frame portion and the back frame portion. The suction force may lead to the attachment or fixed joint between the front frame portion and the back frame portion to mechanically hold and electrically contact the substrate between the front frame portion and the back frame portion.

The new plating frame unit can be understood as a wet-contact vacuum frame, where the front frame portion and the back frame portion are held in place by the suction force. The suction force may lead to a mechanical force onto the substrate to hold the substrate between the front frame portion and the back frame portion. In other words, the front frame portion and the back frame portion can be understood as two part- or half-frames, which are pulled together by the reduced pressure or vacuum instead of the conventionally used mechanic fastening devices, as e.g. screws to hold and contact the substrate.

The new plating frame unit may allow an improved fastening of the substrate with excellent mechanical stability and in particular homogeneous and well-defined forces being exerted onto the substrate. This may result in very reliable electrical contacts, especially on at least a front side and/or a backside of the substrate, which allows a very uniform electroplating. The new plating frame unit may enable a simple, fast and reliable automatic loading and unloading of large-scale substrates, while manual loading is preferably still possible.

The new plating frame unit may eliminate or at least significantly reduce the side effects of electroplating on the electrical contacts, which may allow a stable electroplating of subsequently processed substrates. The new plating frame unit may significantly mitigate or reduce an over-plating in the electrical contact areas on the substrate surface, which may allow a stable electroplating during subsequent processing steps of the same substrate. The new plating frame unit may significantly reduce a shielded contact area during electroplating, which leaves more of the surface area to be used for functionality.

The new plating frame unit may be very easy, efficient and effective to rinse and dry, without increasing a rinse and dry time and/or without leaving drying residues (like water stains) on the substrate surface, especially in material corners, edges and gaps.

In an embodiment, the vacuum unit comprises an internal reduced pressure source arranged within the plating frame. The internal reduced pressure source may be a pump, preferably a vacuum pump. It may be arranged between the front frame portion and the back frame portion. It may be attached to the front plate and/or to the back plate.

In an embodiment, the vacuum unit comprises a vacuum connection line configured to be connected to an external reduced pressure source arranged outside the plating frame. This can be alternatively or additionally to the internal reduced pressure source. In the latter case, the external reduced pressure source may be dimensioned to initially install the reduced pressure, while the internal reduced pressure source may be dimensioned to only adjust the reduced pressure, for example to changed conditions or pressure losses. The external reduced pressure source may be arranged at a loading/unloading station for the substrate. The external reduced pressure source may be a pump, preferably a vacuum pump.

In an embodiment, the plating frame unit further comprises electric contact portions arranged at the front frame portion and/or the back frame portion to contact the substrate electrically. The electric contact portions may comprise electrical contacts pressing onto the substrate. In an embodiment, the electric contact portions extend from the front frame portion into the front recess portion. In an embodiment, the electric contact portions extend from the back frame portion into the back recess portion. In an embodiment, the electric contact portions are finger-shaped. This means they have a longitudinal extension, which is larger than their width perpendicular to their longitudinal extension. Further, the longitudinal extension and/or the width is preferably larger than their material or wall thickness. The electrical contacts can be made from metal or an alloy (e.g. a Cu alloy) with a non-conductive coating (e.g. made from plastic and in particular from a polymer as a thermoplastic fluoropolymer e.g. Halar) to only expose the electrically conductive metal or alloy at a location of direct contact of the electric contact portions relative to the substrate. The shape of the electric contact portions with or without coating may reduce an open electrical contact area to only the direct contact with the substrate surface in order to significantly reduce an over-plating on the electric contact portions.

Above described design may ensure that only an absolute minimum of the substrate is shielded or shadowed from the electrolyte solution, which leaves more of the surface area to be used for functionality. Another advantage of the extending or finger-shaped electric contact portions is an excellent rinsing and drying property, as only an absolute minimum of the substrate is shielded or shadowed from the rinsing liquid and the drying gas flow. There is only a minimum amount of resistance to a meniscus of rinsing liquid when the substrate is pulled out from a rinse tank and only a minimum amount of resistance to a drying gas flow as well as no hidden corners, which makes a risk of leaving residues extremely low.

In an embodiment, the electric contact portions are provided at the front frame portion and the back frame portion.

The electric contact portions at the front frame portion may be displaced relative to the electric contact portions at the back frame portion. In other words, the electrical contact portions or fingers on the front frame portion or half-frame and on the back frame portion or half-frame are not aligned to the same position, but shifted by a certain distance relative to each other. In specific, the contact portions or fingers can be offset from left to right and from top to bottom. This displaced arrangement of the electric contact portions may enable a more uniform electroplating.

The longitudinally extending or finger-shaped electric contact portions at the front frame portion may have a first direction; the finger-shaped electric contact portions at the back frame portion may have a second direction. The direction may be the same, but is preferably different. For example, the first and the second directions intersect, so that the finger-shaped electric contact portions at the front frame portion and the finger-shaped electric contact portions at the back frame portion would cross each other when seen in a top view. The direction may be characterized by an angle with an edge of the respective frame portion. An angle between the finger-shaped electric contact portion and the adjacent edge of the corresponding frame portion may be in a range of 10° to 80°, preferably in a range of 20° to 70°, more preferably in a range of 30° to 70°.

The displaced arrangement of the electric contact portions may enable multiple subsequent processing of the same substrate without increasing the deposited metal layer in the contact areas. This may be achieved by mounting the substrate in two subsequent processes first upside-down and then rotated by 180 degrees. In this way, the average over-plating in the contact areas is being equilibrated over the whole substrate edges. For example, if during subsequent processing a set of two, three or more plating frames is applied, the plating frames all only differing in the placement of the fingers, no electrical contact points are being contacted twice. This may result in an ultimate smoothness of the metal deposition on the substrate edges and this may enable a use of a significant larger part of the substrate for functional devices. This reduces the Cost-of-Consumables and allows savings in substrates as well as chemicals, electricity and other needed resources.

In an embodiment, the electric contact portions are spring loaded. The electrical contacts may be made from metal (e.g. Au) or an alloy and a membrane made from a plastic material (e.g. PTFE) can be implemented to achieve the spring load function. The spring loaded electric contact portion can be understood as pogo pin and may comprise a plunger, a barrel and a spring. When force is applied to the pin, the spring is compressed and the plunger moves inside the barrel. The shape of the barrel retains the plunger, stops the spring from pushing it out when the pin is not locked in place. Preferably, there is a sealing or membrane between the plunger and the barrel to prevent any liquid or electrolyte from entering the barrel and come in contact with the spring. Otherwise, the liquid or electrolyte might crystallize and hinder the movement of the spring and thereby the movement of the electric contact portion. In other words, the spring load may prevent any liquid or electrolyte leakage into areas where the liquid or electrolyte should not be getting into. An excellent electrical contact is always ensured and can be automatically tested before the plating frame with the substrate is immersed into an electroplating solution. A spring load force may be configured and designed such that each electrical contact portion exercises the same constant force onto the substrate ensuring a constant power density being transmitted from the electrical contact portions to the substrate to ensure a uniform electroplating.

In an embodiment, the plating frame unit further comprises a sealing unit arranged at the front frame portion and/or the back frame portion to seal the front frame portion relative to the back frame portion. The sealing unit may be or comprise a sealing ring. The sealing unit may be arranged around the electrical contacts. It may avoid that the electrical contacts are subjected to the electrolyte and electroplated.

The advantage of using reduced pressure or vacuum to hold the front plate and the back plate as two part- or half-frames together compared to conventional mechanical fastening devices as e.g. screws is that a very uniform, well-defined and therefore lower force can be applied. This enables an application of softer materials compared to the prior art application of stainless steel and the like to build the plating frame unit. The advantage of many softer materials, as e.g. Al or many copper alloys, are that they have, as a fundamental material property, a much higher conductivity for electricity as well as temperature and therefore permit higher current densities (up to 400 Ampere) to reach the substrate surface and with this enable deposition processes with significantly higher speed. This results in a significant increase in substrate throughput per deposition equipment and with this in a significant decrease in Cost-of-Ownership for the equipment and higher profitability. A high thermal conductivity is also of advantage for safety reasons in order to avoid overheating in case of e.g. sudden locally very high current densities. Many materials can be used with this design to build the new plating frame unit, e.g. stainless steel, Ti—Pt, Au, Pt, CuSn6, Ag, CuBe, and the like.

As explained above, the use of reduced pressure or vacuum may enable a more uniform and therefore lower force to hold the substrate compared to conventionally used mechanical fastening devices as e.g. screws. The lower force may enable a use of thinner plating frames consisting of the front plate and the back plate compared to the prior art. In an embodiment, the thickness of the plating frame at a position of the connected front frame portion and back frame portion is 15 mm or less, preferably 13 mm or less. In an example, the thickness of the plating frame at a position of the connected front frame portion and back frame portion is in a range of 5 to 15 mm, more preferably 5 to 10 mm. The thinner plating frames may enable that the substrate can be placed significantly closer to a (e.g. high-speed plating) distribution body compared to the prior art, which may further increase a plating speed.

As explained above, the use of reduced pressure or vacuum may enable a use of a lower force and thereby a use of softer plating frames compared to the prior art. In an embodiment, the front frame portion and/or the back frame is/are made from a material with a yield strength of 500 MPa and less. The front frame portion and/or the back frame can be made from a material with a yield strength of 400 MPa and less. The yield strength may be in a range of 50 to 300 MPa, preferably 50 to 200 MPa, more preferably 50 to 100 MPa. The front frame portion and/or the back frame can be made from a material with a yield strength smaller than a yield strength of steel, which is conventionally used.

The use of reduced pressure or vacuum may enable a lower force and thereby a use of softer and/or thinner plating frames (front plate and back plate together) compared to the prior art. Softer and/or thinner plating frames may have a higher conductivity for electricity as well as temperature compared to the prior art materials (e.g. steel) and therefore permit higher current densities to reach the substrate surface and with this enable deposition processes with significantly higher speed. In an embodiment, the front frame portion and/or the back frame is/are made from a material with an electrical conductivity of $2*10^6$ S/m and more at 20° C., preferably $3*10^6$ S/m and more at 20° C., more preferably $4*10^6$ S/m and more. In an embodiment, the front frame portion and/or the back frame is/are made from a material with a thermal conductivity of 65 W/mK and more at 20° C., preferably 150 W/mK and more at 20° C., more preferably 250 W/mK and more at 20° C. The front frame portion and/or the back frame can be made from a material with an electrical conductivity and/or a thermal conductivity larger than an electrical conductivity and/or a thermal conductivity of steel, which is conventionally used.

In an embodiment, the front frame portion and/or the back frame is/are coated with a polymer material or the like. The coating may be made from plastic and in particular from a polymer as a thermoplastic fluoropolymer. It can be made from Halar, perfluoroalkoxy alkanes or the like. The coating may protect the front frame portion and/or the back frame from chemical attack.

In an embodiment, the plating frame unit further comprises a locking unit arranged at the front plate and/or the back plate to lock the front frame portion relative to the back frame portion. The locking unit can be understood as a second locking element besides to the above described first locking element by means of the reduced pressure between the front frame portion and the back frame portion. In other words, the locking unit may form an additional locking mechanism in addition to the reduced pressure or vacuum. It may be a backup in case the reduced pressure or vacuum might fail. The first and the second locking element may form together a preferably automated dual locking mechanism. The locking unit or second locking element can be based on a reduced pressure or vacuum reservoir, an (electro-) magnetic force, a mechanic clamping force or another technology, which is capable to secure the substrate in place in case the first locking element by means of the reduced pressure between the front frame portion and the back frame portion should fail to hold the two frame parts together.

In an embodiment, the plating frame unit further comprises a handling device. The combination of plating frame unit and handling device can also be understood as plating frame system. The handling or Bernoulli device may be configured for a contactless holding of the substrate, which means it may hold the substrate without contacting the substrate. The contactless holding may be understood as holding or supporting the substrate without touching or getting in contact with the substrate. "Contactless" and "without touching or getting in contact" can be understood as essentially contactless and essentially without touching or getting in contact with the substrate. Specific or sensitive parts or the functional structures or the largest area of the substrate are not touched. However, the substrate may be touched at edge(s), corner(s) or particular designated (exclusion) zone(s) or small areas(s) of the substrate. The handling device may touch and hold the substrate by means of passive means (e.g. pins) or active means (e.g. clamps). The reason is to protect the surface of the substrate and the functional structures provided on the surface of the substrate. The handling device may hold the substrate and in particular secure it against a gliding as e.g. a lateral gliding. The handling device may also straighten a curved substrate, which means make it more even or planar. The handling device may be moveable relative to the front plate and/or the back plate to move the substrate relative to the plating frame formed by the front plate and back plate. The handling device may be configured to move, handle or transport the substrate within the plating frame and in particular within a chamber formed by the front plate and the back plate of the plating frame. The handling device may be moveable in a lateral (horizontal) direction along a width of the plating frame and/or the substrate perpendicular to a longitudinal extension of the plating frame and/or the substrate. The handling device may be moveable in a first (X) and a second (Y) lateral (horizontal) direction perpendicular to a longitudinal extension of the plating frame and/or the substrate.

In an embodiment, the plating frame unit further comprises a handling arm, which is configured to touch and hold the substrate in particular only in a predetermined holding portion of the substrate, e.g. a so-called exclusion zone outside of functional structures or other sensible portions on the substrate surface. The combination of plating frame unit and handling arm can also be understood as plating frame system. The predetermined holding portion of the substrate may be arranged at edges and/or corners of the substrate. The handling or robotic arm may hold the substrate by means of e.g. a vacuum end effector, a magnetic grip, a mechanic clamp or the like. The handling arm may be moveable relative to the front plate and/or the back plate to move the substrate relative to the plating frame (front plate and back plate together). The handling device can be used to move, handle or transport the substrate into and/or out of the plating frame and in particular into and/or out of an opened chamber formed by the front plate and the back plate of the plating frame. The handling arm may be moveable in a linear (vertical) direction along the longitudinal extension of the plating frame and/or the substrate.

A combination of the handling arm and the contactless handling device can be configured to bring the substrate to or near the plating frame by means of the handling arm, which grips and holds the substrate at at least a suitable predetermined holding portion (exclusion zone) of the substrate. The handling arm may then be configured to shift or hand over the substrate to the handling device, which may contactless hold the substrate even in the areas of functional structures or other sensible portions on the substrate surface. The handling arm and/or the handling device may be configured to bring the substrate into the open plating frame formed by the front plate and the back plate. The handling device may be configured to move and adjust the substrate within the plating frame. The handling device can be configured to hold the substrate until the plating frame is used to hold the substrate by means of the applied suction force and then the handling device can be configured to release the substrate. The handling device and the handling arm may be moved back to their rest positions.

In other words, the substrate may first be held and moved by the handling arm holding the predetermined holding portions of the substrate. The substrate may then be contactless gripped by the handling device at e.g. arbitrary and even functional or sensible portions on the substrate surface. The handling arm may release the predetermined holding portions as soon as the handling device holds the substrate. The handling device may maneuver the substrate into the plating frame. The predetermined holding portions of the substrate may now be free to be gripped by the plating frame. The handling device may release the substrate surface as soon as the plating frame holds the substrate. As a result, the substrate can be handled and maneuvered without damaging the functional structures and other sensible portions on the substrate surface.

In an embodiment, the plating frame unit further comprises a control unit to control the motion(s) of the handling device and the handling arm as well as the fastening(s) and/or release(s) of the substrate by the handling device and the handling arm. The control unit may further be configured to control the fastening and/or release of the substrate by means of the plating frame.

According to the present disclosure, also a plating system for holding a substrate in a chemical and/or electrolytic surface treatment of the substrate is presented. The plating system comprises the plating frame unit as described above and a substrate. The substrate is held between a front frame portion and a back frame portion of the plating frame unit.

According to the present disclosure, also a method for assembling a plating frame unit for holding a substrate in a chemical and/or electrolytic surface treatment of the substrate is presented. The method for assembling the plating frame unit comprises the following steps, not necessarily in this order:

- providing a front plate with a front frame portion surrounding a front recess portion,
- providing a back plate with a back frame portion,
- inserting a substrate between the front frame portion and the back frame portion so that they hold the substrate between them, and
- reducing an inner pressure between the front frame portion and the back frame portion below a surrounding pressure to attach the front frame portion relative to the back frame portion.

The new method for assembling a plating frame unit may allow assembling a plating frame unit with an improved fastening of the substrate with excellent mechanical stability and in particular homogeneous and well-defined forces being exerted onto the substrate. This may result in providing very reliable electrical contacts, especially on at least a front side and/or a backside of the substrate, which allows a very uniform electroplating after the assembling.

The new method for assembling a plating frame unit may eliminate or at least significantly reduce the side effects of electroplating on the electrical contacts, which may allow a stable electroplating of subsequently processed substrates.

The new method for assembling a plating frame unit may allow assembling a plating frame unit, which is very easy, efficient and effective to rinse and dry, without increasing a rinse and dry time and/or without leaving drying residues (like water stains) on the substrate surface, especially in material corners, edges and gaps.

In an embodiment, the method for assembling a plating frame unit comprises a providing of an internal reduced pressure source arranged within the plating frame unit. In an embodiment, the method for assembling a plating frame unit comprises a providing of a vacuum connection line configured to be connected to an external reduced pressure source arranged outside the plating frame unit.

In an embodiment, the method for assembling a plating frame unit comprises an arrangement of electric contact portions at the front frame portion and/or the back frame portion to contact the substrate electrically. The electric contact portions may comprise electrical contacts pressing onto the substrate. The electric contact portions may extend from the front frame portion into the front recess portion. The electric contact portions may extend from the back frame portion into the back recess portion. In an embodiment, the electric contact portions are finger-shaped. The electric contact portions at the front frame portion may be displaced relative to the electric contact portions at the back frame portion.

In an embodiment, the method for assembling a plating frame unit comprises an arrangement of a sealing unit arranged at the front frame portion and/or the back frame portion to seal the front frame portion relative to the back frame portion.

In an embodiment, the method for assembling a plating frame unit comprises an arrangement of a locking unit arranged at the front plate and/or the back plate to lock the front frame portion relative to the back frame portion.

In an embodiment, the method for assembling a plating frame unit comprises a holding and/or moving of the substrate close to the plating frame unit by means of a handling arm contacting at least a predetermined holding portion of the substrate. In an embodiment, the method for assembling a plating frame unit comprises a contactless holding and/or moving of the substrate within the plating frame unit by means of a handling device contacting e.g. an arbitrary and even functional or sensible portion on the substrate surface. In an embodiment, the method for assembling a plating frame unit comprises a release of the handling arm and the predetermined holding portions as soon as the handling device holds the substrate. In an embodiment, the method for assembling a plating frame unit comprises a holding and/or contacting of the substrate by means of the plating frame, preferably at the predetermined holding portion of the substrate. In an embodiment, the method for assembling a plating frame unit comprises a release of the handling device as soon as the plating frame holds the substrate.

It shall be understood that the device and the method according to the independent claims have similar and/or identical preferred embodiments, in particular, as defined in the dependent claims. It shall be understood further that a preferred embodiment of the disclosure can also be any combination of the dependent claims with the respective independent claim.

These and other aspects of the present disclosure will become apparent from and be elucidated with reference to the embodiments described hereinafter.

BRIEF DESCRIPTION OF THE DRAWINGS

Exemplary embodiments of the disclosure will be described in the following with reference to the accompanying drawing.

DETAILED DESCRIPTION OF EMBODIMENTS

Figure 1:
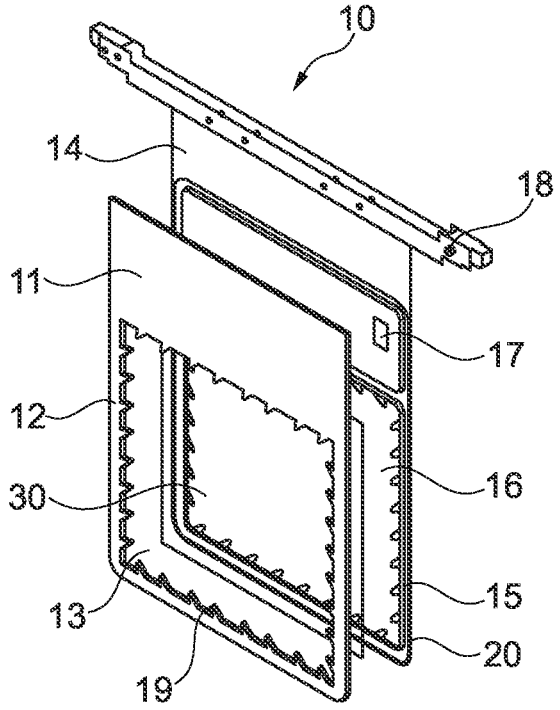
FIG. 1 shows schematically and exemplarily an embodiment of a plating system according to the disclosure for holding a substrate in a chemical and/or electrolytic surface treatment of the substrate.

FIG. 1 shows schematically and exemplarily an embodiment of a plating system according to the disclosure for holding a substrate 30 in a chemical and/or electrolytic surface treatment of the substrate 30. The plating system is shown in FIG. 1 in an exploded view. The plating system comprises the substrate 30 and a plating frame unit 10 according to the disclosure for holding a substrate 30 in a chemical and/or electrolytic surface treatment of the substrate 30.

The plating frame unit 10 comprises a front plate 11, a back plate 14, and a vacuum unit 17.

The front plate 11 comprises a front frame portion 12 surrounding a front recess portion 13.

The back plate 14 comprises a back frame portion 15 surrounding a back recess portion 16.

The front frame portion 12 and the back frame portion 15 are connected to each other to hold the substrate 30 between them. The front frame portion 12 and the back frame portion 15 are in an assembled state not fastened to each other, but only in contact with each other.

The vacuum unit 17 is configured to reduce an inner pressure between the front frame portion 12 and the back frame portion 15 below a surrounding pressure to attach the front frame portion 12 relative to the back frame portion 15. The vacuum unit 17 is here at least a suction pump. The inner pressure is the pressure within an interior of a cavity or chamber formed and surrounded by the front frame portion 12 and the back frame portion 15. The surrounding pressure is here atmosphere pressure.

The vacuum unit 17 comprises here an internal reduced pressure source arranged within the plating frame unit 10 and at the back plate 14. The vacuum unit 17 here further comprises a vacuum connection line 18, which is connected to an external reduced pressure source (not shown) arranged outside the plating frame unit 10.

The substrate 30 is held between the front frame portion 12 and the back frame portion 15 of the plating frame unit 10. The pressure difference between the inner pressure and the surrounding pressure leads to a suction force between the front frame portion 12 and the back frame portion 15. The suction force in turn leads to the attachment of the front frame portion 12 relative to the back frame portion 15 to mechanically hold and electrically contact the substrate 30 between the front frame portion 12 and the back frame portion 15.

The plating frame unit 10 comprises a sealing unit 20 here arranged at the back frame portion 15 to seal the front frame portion 12 and the back frame portion 15 relative to each other to avoid that the electrical contacts are subjected to the electrolyte and are electroplated. The sealing unit 20 comprises here two sealing rings.

Figure 2:
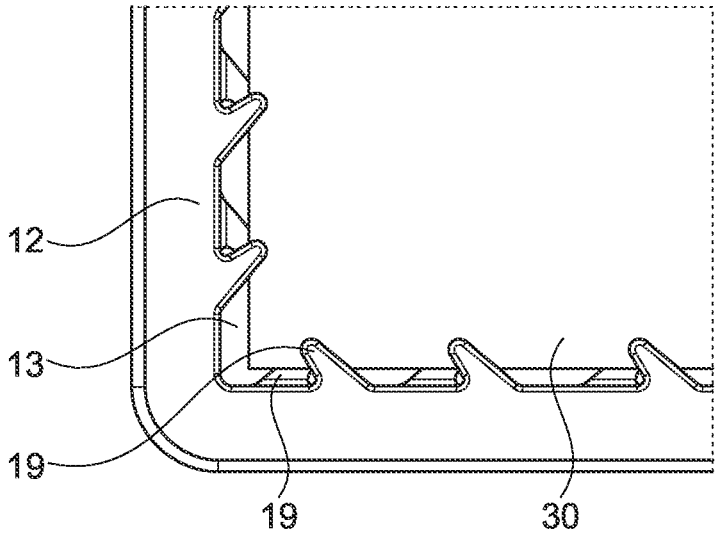
FIG. 2 shows schematically and exemplarily a detail of an embodiment of a plating frame unit according to the disclosure for holding a substrate in a chemical and/or electrolytic surface treatment of the substrate.

FIG. 2 shows schematically and exemplarily a detail of an embodiment of a plating frame unit 10 according to the disclosure for holding a substrate 30 in a chemical and/or electrolytic surface treatment of the substrate 30. As shown in FIGS. 1 and 2, the plating frame unit 10 comprises a plurality of electric contact portions 19 arranged at the front frame portion 12 and the back frame portion 15 to contact the substrate 30 electrically. The electric contact portions 19 extend from the front frame portion 12 into the front recess portion 13 or the back recess portion 16. The electric contact portions 19 are finger-shaped, which means they have a longitudinal extension, which is larger than their width perpendicular to their longitudinal extension. The longitudinal extensions of the electric contact portions 19 mounted to the front frame portion 12 extend into an opposite direction relative to the longitudinal extensions of the electric contact portions 19 mounted to the back frame portion 15. When seen in the top view of FIG. 2, the electric contact portions 19 mounted to the front frame portion 12 intersect with the electric contact portions 19 mounted to the back frame portion 15. Further, the electric contact portions 19 at the front frame portion 12 and the electric contact portions 19 mounted to the back frame portion 15 do not origin at the same position, they are displaced or offset relative to each other.

Figure 3A:
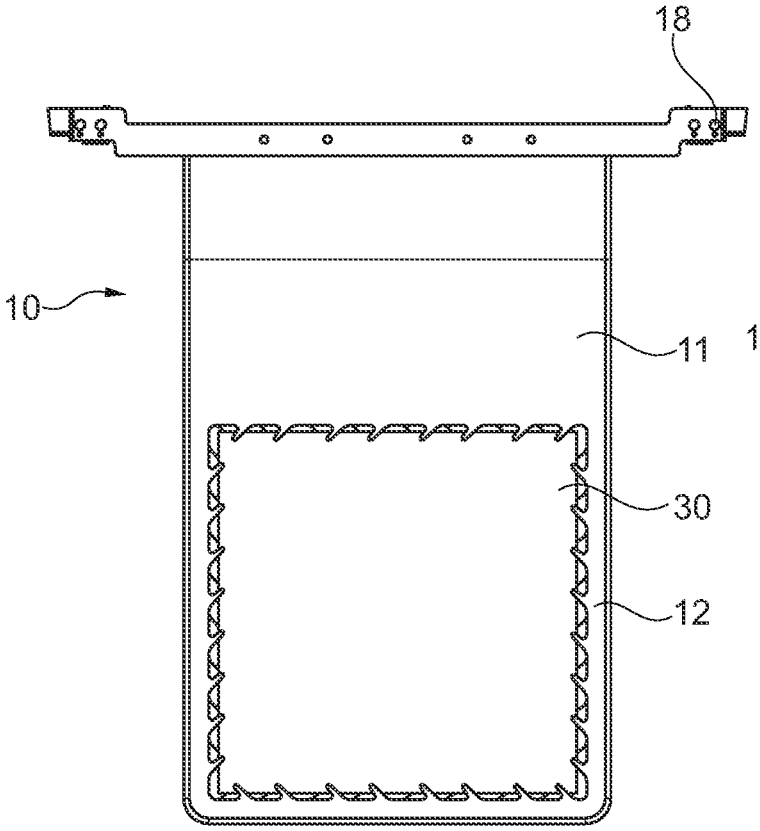
FIG. 3*a* shows schematically and exemplarily an embodiment of a plating system according to the disclosure for holding a substrate in a chemical and/or electrolytic surface treatment of the substrate in a top view.
Figure 3B:
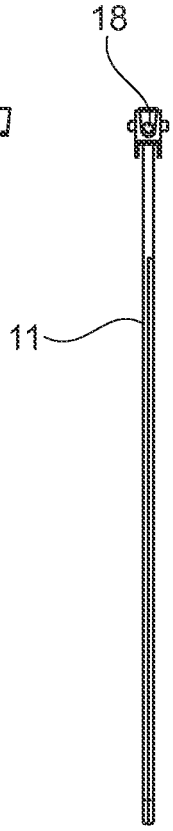
FIG. 3*b* shows the same plating system in a side view.

FIG. 3*a* shows schematically and exemplarily an embodiment of a plating system according to the disclosure for holding a substrate 30 in a chemical and/or electrolytic surface treatment of the substrate 30 in a top view, FIG. 3*b* shows the same plating system in a side view. As in FIG. 1, the plating system comprises a substrate 30 and a plating frame unit 10. The plating frame unit 10 comprises a front plate 11, a back plate 14, and a vacuum unit. The front plate 11 comprises a front frame portion 12 surrounding a front recess portion 13. The back plate 14 comprises a back frame portion 15 surrounding a back recess portion 16. The vacuum unit here comprises a vacuum connection line 18, which is connected to an external reduced pressure source (not shown) arranged outside the plating frame unit 10.

The front frame portion 12 and the back frame portion 15 are in the assembled state only in contact with each other. The pressure difference between the inner pressure and the surrounding pressure leads to a suction force between the front frame portion 12 and the back frame portion 15. The suction force in turn leads to a fixed attachment of the front frame portion 12 relative to the back frame portion 15 to mechanically hold and electrically contact the substrate 30 between the front frame portion 12 and the back frame portion 15.

Figure 4:
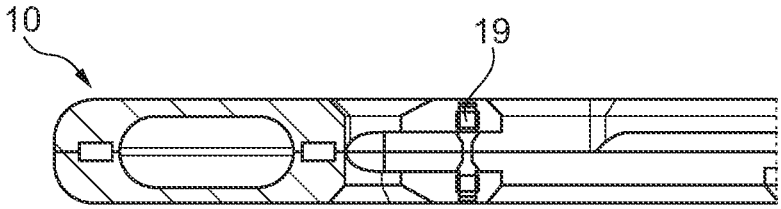
FIG. 4 shows schematically and exemplarily an embodiment of a plating frame unit according to the disclosure for holding a substrate in a chemical and/or electrolytic surface treatment of the substrate in a cross section.
Figure 5:
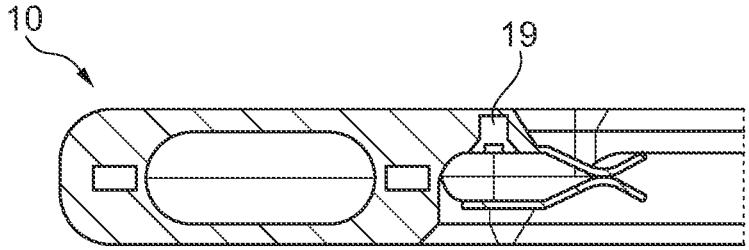
FIG. 5 shows schematically and exemplarily an embodiment of a plating frame unit according to the disclosure for holding a substrate in a chemical and/or electrolytic surface treatment of the substrate in a cross section.

FIGS. 4 and 5 show schematically and exemplarily an embodiment of a plating frame unit 10 according to the disclosure for holding a substrate in a chemical and/or electrolytic surface treatment of the substrate in a cross section. The electric contact portion 19 is spring loaded.

Figure 6:
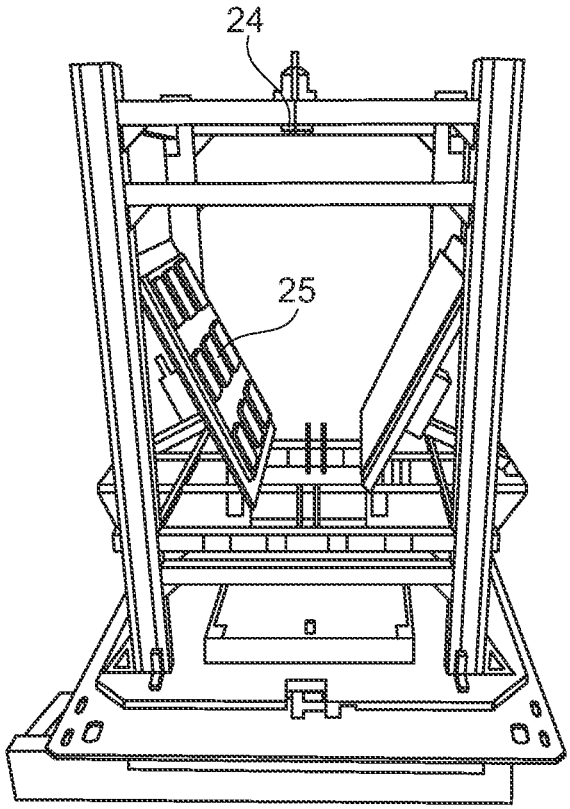
FIG. 6 shows schematically and exemplarily an embodiment of a plating system according to the disclosure for holding a substrate in a chemical and/or electrolytic surface treatment of the substrate.

FIG. 6 shows schematically and exemplarily an embodiment of a plating system according to the disclosure for holding a substrate 30 in a chemical and/or electrolytic surface treatment of the substrate 30 in an overall 3D view. The plating system here comprises a handling device 25 or Bernoulli device for a contactless holding of the substrate 30 without touching the substrate 30 to protect the surface of the substrate 30 and the functional structures provided on the substrate 30 surface. The handling device 25 may transport the substrate 30 within the plating frame, which can be understood as a chamber formed by the front plate 11 and the back plate 14 of the plating frame unit 10. The handling device 25 is here moveable in at least one lateral (horizontal) direction along a width of the plating frame unit 10 and/or the substrate 30 perpendicular to a longitudinal extension of the plating frame unit 10 and/or the substrate 30.

The plating system here further comprises a handling arm 24 to touch and hold the substrate 30 in in a predetermined holding portion of the substrate 30 outside of functional structures or other sensible portions on the substrate surface. The handling or robotic arm may hold the substrate 30 by means of e.g. a vacuum end effector or the like. The handling arm 24 is moveable relative to the front plate 11 and/or the back plate 14 to move the substrate 30 relative to the front plate 11 and/or the back plate 14. The handling device 25 may move transport the substrate 30 into and/or out of the plating frame, which can be understood as a chamber formed by the front plate 11 and the back plate 14 of the plating frame unit 10. The handling arm 24 is here moveable in a linear (vertical) direction along the longitudinal extension of the plating frame unit 10 and/or the substrate 30.

The combination of the handling arm 24 and the contactless handling device 25 can bring the substrate 30 near the plating frame by means of the handling arm 24, which grips and holds the substrate 30 at a suitable predetermined holding portion. The handling arm 24 can then shift the substrate 30 to the handling device 25, which contactless holds the substrate 30 even in the areas of functional structures or other sensible portions on the substrate surface. The handling device 25 can insert and adjust the substrate 30 in the open plating frame. The handling device 25 can hold the substrate 30 until the plating frame is closed to hold the substrate 30 by means of the applied suction force and then the handling device 25 can be released and moved back to a start or rest position.

Figure 7:
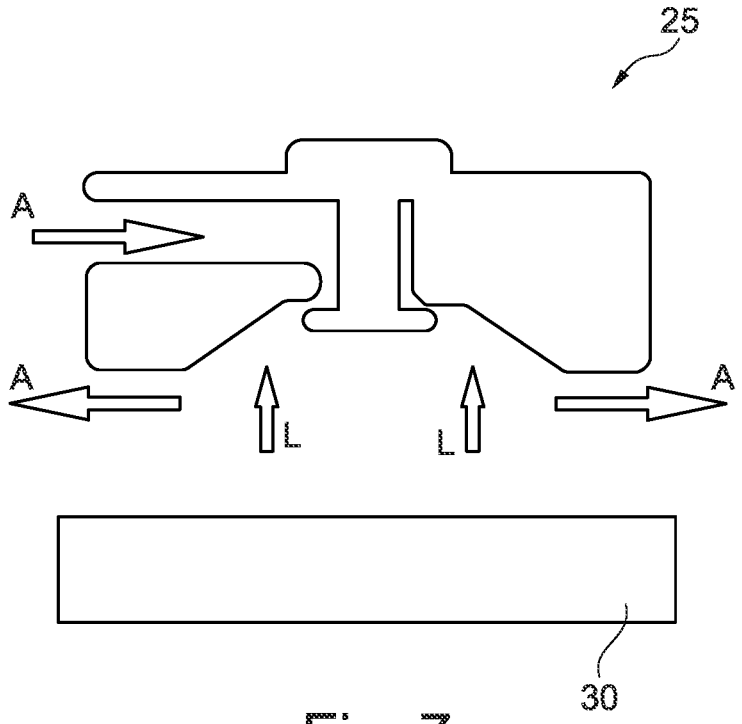
FIG. 7 shows schematically and exemplarily an embodiment of a handling device or Bernoulli device for a contactless holding of the substrate.

FIG. 7 shows schematically and exemplarily an embodiment of a handling device 25 or Bernoulli device for a contactless holding of the substrate. The substrate 30 will be held by a lifting force L or suction force, which is provided by an air pressure A or air stream through the handling device 25.

It has to be noted that embodiments of the disclosure are described with reference to different subject matters. In particular, some embodiments are described with reference to method type claims whereas other embodiments are described with reference to the device type claims. However, a person skilled in the art will gather from the above and the following description that, unless otherwise notified, in addition to any combination of features belonging to one type of subject matter also any combination between features relating to different subject matters is considered to be disclosed with this application. However, all features can be combined providing synergetic effects that are more than the simple summation of the features.

While the disclosure has been illustrated and described in detail in the drawings and foregoing description, such illustration and description are to be considered illustrative or exemplary and not restrictive. The disclosure is not limited to the disclosed embodiments. Other variations to the disclosed embodiments can be understood and effected by those skilled in the art in practicing a claimed disclosure, from a study of the drawings, the disclosure, and the dependent claims.

In the claims, the word "comprising" does not exclude other elements or steps, and the indefinite article "a" or "an" does not exclude a plurality. A single processor or other unit may fulfil the functions of several items re-cited in the claims. The mere fact that certain measures are re-cited in mutually different dependent claims does not indicate that a combination of these measures cannot be used to advantage. Any reference signs in the claims should not be construed as limiting the scope.

The invention claimed is:

1. A plating frame unit for holding a substrate in a chemical and/or electrolytic surface treatment of the substrate, comprising:

a front plate, a back plate, and a vacuum unit, wherein the front plate comprises a front frame portion surrounding a front recess portion, wherein the back plate comprises a back frame portion, wherein the front frame portion and the back frame portion are connected to each other to hold the substrate between them, and wherein the vacuum unit is configured to reduce an inner pressure between the front frame portion and the back frame portion below a surrounding pressure to attach the front frame portion relative to the back frame portion, the plating frame unit further comprising electric contact portions provided at the front frame portion and the back frame portion, the electric contact portions being arranged at the front frame portion and the back frame portion to contact the substrate electrically, wherein the electric contact portions are finger-shaped, wherein the finger-shaped electric contact portions at the front frame portion have a first direction opposite to a second direction of the finger-shaped electric contact portions at the back frame portion, and wherein the first direction and the second direction intersect each other so that the finger-shaped electric contact portions at the front frame portion and the finger-shaped electric contact portions at the back frame portion cross each other when seen from a top view, the top view being across the front plate or the back plate, parallel to a longitudinal axis of the front plate and the back plate.

2. The plating frame unit according to claim 1, wherein the vacuum unit comprises an internal reduced pressure source arranged within the plating frame unit or a vacuum connection line configured to be connected to an external reduced pressure source arranged outside the plating frame unit.

3. The plating frame unit according to claim 1, wherein the back frame portion surrounds a back recess portion.

4. The plating frame unit according to claim 1, wherein the electric contact portions extend from the front frame portion into the front recess portion and/or from the back frame portion into the back recess portion.

5. The plating frame unit according to claim 1, wherein the electric contact portions are provided at the front frame portion and the back frame portion, and wherein the electric contact portions at the front frame portion are displaced relative to the electric contact portions at the back frame portion.

6. The plating frame unit according to claim 1, wherein the electric contact portions are spring loaded.

7. The plating frame unit according to claim 1, further comprising a sealing unit arranged at the front frame portion and/or the back frame portion to seal the front frame portion relative to the back frame portion.

8. The plating frame unit according to claim 1, wherein a thickness of the front frame portion and the back frame portion together is 15 mm or less.

9. The plating frame unit according to claim 1, wherein the front frame portion and/or the back frame is/are made from a material with a yield strength of 500 MPa and less, an electrical conductivity of $2*10^6$ S/m and more, and/or a thermal conductivity of 65 W/mK and more.

10. The plating frame unit according to claim 1, further comprising a locking unit arranged at the front plate and/or the back plate to lock the front frame portion relative to the back frame portion.

11. The plating frame unit according to claim 1, further comprising a handling device for a contactless holding of the substrate and which is moveable relative to the front plate and/or the back plate to move the substrate relative to the plating frame unit.

12. The plating frame unit according to claim 1, further comprising a handling arm for touching and holding a predetermined holding portion of the substrate and which is moveable relative to the front plate and/or the back plate to move the substrate relative to the plating frame unit.

13. The plating frame unit according to claim 1, wherein the first direction and the second direction are characterized by an angle between the finger-shaped electric contact portion and a corresponding edge of a respective one of the front frame portion and the back frame portion, the angle being in a range of 10° to 80°.

14. A method for assembling a plating frame unit for holding a substrate in a chemical and/or electrolytic surface treatment of the substrate, comprising:

providing a front plate with a front frame portion surrounding a front recess portion;

providing a back plate with a back frame portion;

inserting a substrate between the front frame portion and the back frame portion so that they hold the substrate between them; and reducing an inner pressure between the front frame portion and the back frame portion below a surrounding pressure to attach the front frame portion relative to the back frame portion;

wherein electric contact portions are provided at the front frame portion and the back frame portion, wherein the electric contact portions are arranged at the front frame portion and the back frame portion to contact the substrate electrically, wherein the electric contact portions are finger-shaped, wherein the finger-shaped electric contact portions at the front frame portion have a first direction opposite to a second direction of the finger-shaped electric contact portions at the back frame portion, and wherein the first direction and the second direction intersect each other so that the finger-shaped electric contact portions at the front frame portion and the finger-shaped electric contact portions at the back frame portion cross each other when seen from a top view, the top view being across the front plate or the back plate, parallel to a longitudinal axis of the front plate and the back plate.

* * * * *